US007175743B2

(12) United States Patent
Murakami

(10) Patent No.: US 7,175,743 B2
(45) Date of Patent: Feb. 13, 2007

(54) ANTIFOULING PAPERMAKER'S FABRIC

(75) Inventor: Shinya Murakami, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 522 days.

(21) Appl. No.: 10/654,877

(22) Filed: Sep. 5, 2003

(65) Prior Publication Data

US 2004/0040612 A1 Mar. 4, 2004

(51) Int. Cl.
*D21F 1/10* (2006.01)
*D03D 25/00* (2006.01)
*D06M 15/55* (2006.01)

(52) U.S. Cl. ..... 162/348; 162/199; 162/903; 442/118; 442/164; 139/425 A

(58) Field of Classification Search ..... 162/348, 162/116, 117, 199, 358.2, 900, 902, 903, 162/272, 274; 34/95; 139/383 A, 425 A; 8/110, 142; 427/407.1, 410, 412; 442/63, 442/79, 80, 91, 93, 118, 164, 168–171
See application file for complete search history.

(56) References Cited

U.S. PATENT DOCUMENTS 3,573,089 A * 3/1971 Tate ..... 442/19
3,833,457 A * 9/1974 Misumi et al. ..... 428/457
4,794,036 A * 12/1988 Tate ..... 442/71

* cited by examiner

*Primary Examiner*—Eric Hug
(74) *Attorney, Agent, or Firm*—Rader, Fishman & Grauer PLLC

(57) ABSTRACT

In an antifouling papermaker's fabric woven from a warp and weft made of synthetic resin filament, the fabric is coated with a resin composition made by blending a two-liquid reaction type epoxy resin with a prepolymer of phenolsulfonic acid as a curing agent to form on the surface of a constituent yarn an antifouling coating film constituted by a reaction product of the composition.

9 Claims, No Drawings

ANTIFOULING PAPERMAKER'S FABRIC

TECHNICAL FIELD OF THE INVENTION

The present invention relates to an antifouling papermaker's fabric suitable for forming recycled paper using wastepaper including gum pitches of liners, core boards, cardboards, paperboards and the like as raw materials.

DESCRIPTION OF RELATED ART

A papermaker's fabric for use in a papermaking process is used in a sheet forming unit, and papermaker's fabrics include a fabric woven from a warp and weft made of metal or synthetic resin monofilament. Currently, fabrics made of synthetic resin monofilament are often used because of easy handling. However, compared with the fabric made of metal, the fabric made of synthetic resin monofilament is more likely fouled by sticky resin particles called a resin based gum pitch present in wastepaper, and thus there have been cases where due to deposition of the gum pitch, the water filterability of the fabric is reduced and its surface characteristics are compromised, resulting in production of sheets of uneven formation and sheets having pinholes, thus leading a situation in which use of the fabric must be discontinued. Furthermore, high pressure shower cleaning and treatments with cleaning agents, additives and the like have been carried out for removing the gum pitch, but these measures have a problem such that the synthetic resin monofilament is caused to be damaged or degraded and in addition, the gum pitch cannot be removed sufficiently.

Thus, methods of forming a resin coating film less compatible with a gum pitch on the surface of a constituent yarn of a fabric woven from a synthetic resin monofilament to prevent deposition of the gum pitch have been devised. Such methods include, for example, a method in which the fabric is coated with a hydrophilic resin to form a hydrophilic coating film on the fabric constituent yarn, and the like, as one of typical antifouling methods, but in an antifouling fabric having a conventional hydrophilic resin coating film formed thereon, the antifouling coating film is caused to fall off by high pressure shower, alkali cleaning or the like, resulting in a reduction in antifouling effect, and thus the fabric has the antifouling effect in the early stage of use but becomes hard to retain the effect in the last stage of use.

Typical examples include a paper maker's forming fabric having a cured antifouling coating film formed on the surface of a fabric constituent yarn by coating a one-liquid curing type phenol resin with an antifouling resin made by polymerizing a prepolymer of phenol-sulfonated phenolsulfonic acid. The phenol resin itself is highly hydrophilic and hygroscopic, and is water-insoluble, and the prepolymer of phenol sulfonic acid is a strong acid, and is ultra-hydrophilic. A cured antifouling coating film obtained by polymerizing the phenolsulfonic acid repulses contaminant components released in water, thus providing a situation in which contaminant components are hard to stick directly to the surface of the fabric. However, a curing polycondensation reaction between the phenol resin and the prepolymer of phenolsulfonic acid is hard to proceed sufficiently, and if the reaction does not fully proceed, residual acid components persistently exist, and it is necessary to carry out cleaning to remove them after the coating film is formed. The phenol resin used here is a one-liquid curing type resin, and becomes cured by applying heat thereto, and the phenol resin has a reactivity sufficient to cure the phenol resin itself, but does not have a reactivity sufficient to react with the prepolymer of phenolsulfonic acid mixed with the phenol resin. The prepolymer of phenolsulfonic acid is poor in reactivity, and therefore unreacted components tend to exist after polymerization with the phenol resin.

Furthermore, the fabric has satisfactory antifouling properties in the early stage of use because the hydrophilic coating film is formed on the fabric constituent yarn, but since the resin merely sticks to the constituent yarn by the adhesiveness, curing and the like of the phenol resin, the resin coating film is caused to fall off under severe use conditions, resulting in a reduction in antifouling effect, and a gum pitch starts to be deposited on the fabric in the middle stage of use. The gum pitch can easily be removed if caustic soda (strong alkali), hydrochloric or the like is used, but the curable coating film is poor in resistance to such regents, and therefore there have been cases where use of a reagent causes the resin coating film to fall off, resulting in a further reduction in antifouling effect.

U.S. Pat. No. 2,976,152 describes a papermaker's forming net such that a polymer of vinyl pyrolidone having a hydrophilic nature is mixed with a synthetic resin having an epoxy based resin mixed with a hydrophilic modified polyamide curing agent, a fabric constituent yarn is coated with the resin to form a cured coating film, thereby preventing deposition of contaminants such as a gum pitch. A polyamide resin is used as a curing agent for the epoxy resin, but the polyamide resin only contributes to an improvement in water wettability, and cannot provide an excellent antifouling effect although it contains a hydrophilic amid group. Furthermore, this papermaker's forming net has a hydrophilic curable coating film formed on the fabric constituent yarn and retains the antifouling effect in the early stage of use, but as it is used, although the epoxy resin as a base resin remains on the fabric constituent yarn, the polymer of vinyl pyrolidone being a hydrophilic substance mixed in the epoxy resin is released into water to compromise the hydrophilic nature of the resin itself, thus making it impossible to retain a sufficient level of antifouling effect. This is due to the fact that vinyl pyrolidone is a water-soluble substance, and it is merely mixed with the epoxy resin instead of being strongly tied thereto through a reaction, bonding force or the like.

SUMMARY OF THE INVENTION

The invention is to provide a papermaker's fabric having formed on a fabric constituent yarn an antifouling resin coating film, which is capable of retaining an excellent antifouling effect from the early stage of use to the last stage of use, is excellent in chemical resistance, and does not cause the fabric constituent yarn to be degraded.

The present invention relates to an antifouling papermaker's fabric woven from a warp and weft made of synthetic resin filament, wherein the fabric is coated with a resin composition made by blending a two-liquid reaction type epoxy resin with a prepolymer of phenolsulfonic acid as a curing agent to form on the surface of a constituent yarn an antifouling coating film constituted by a reaction product of the composition;

In the antifouling papermaker's fabric woven from a warp and weft made of synthetic resin filament, the fabric may be coated with a resin composition made by blending a two-liquid reaction type epoxy resin with a prepolymer of phenolsulfonic acid as a curing agent in the ratio of 10:2 to 10:6 to form on the surface of constituent yarn an antifouling coating film constituted by a reaction product of the composition;

The fabric may be woven using a constituent yarn having an antifouling coating film formed on the surface by coating the surface of a synthetic resin filament warp and weft with a resin composition made by blending a two-liquid reaction type epoxy resin with a prepolymer of phenolsulfonic acid, and subjecting the composition to a reaction.

The antifouling papermaker's fabric may be made by mixing an acid dye and/or a metallic complex salt dye with the resin made by blending a two-liquid reaction type epoxy resin with a prepolymer of phenolsulfonic acid.

The fabric woven from a warp and weft made of synthetic resin filament or the resin composition coated on the warp and weft may be heated to a temperature of 100° C. or greater and thereby cured.

DETAILED DESCRIPTION OF THE INVENTION

For solving the aforesaid problems, a two-liquid reaction type epoxy resin is used for a base resin, a prepolymer of phenolsulfonic acid is blended therewith as a curing agent for the epoxy resin to produce an antifouling resin composition, and the resin composition is coated on a fabric constituent yarn to form an antifouling coating film constituted by a reaction product of the composition, thereby imparting an antifouling property to a papermaker's fabric.

The two-liquid reaction type epoxy resin is not cured when the resin is used alone, but is cured when the epoxy resin is mixed with a substance causing the resin to form a three-dimensional linkage and polymerized. Curing agents for the epoxy resin generally include polyamine, polymercaptan and polycarboxylic acid, but a prepolymer of phenolsulfonic acid is used for the curing agent of the epoxy resin in the present invention. This is because the prepolymer of phenolsulfonic acid is ultra-hydrophilic and functions as a curing agent for the two-liquid reaction type epoxy resin, and a resin produced by polymerizing such a prepolymer is easily adsorbed to a polyamide resin that is often used as a constituent yarn of a papermaker's fabric.

The two-liquid curing type epoxy resin forms a three-dimension network structure when a curing agent is added thereto, and in this invention, the epoxy resin is cured through a polyaddition reaction in which the prepolymer of phenolsulfonic acid as a curing itself is incorporated in part of the network structure. Even if the prepolymer of phenolsulfonic acid is poor in reactivity, the polymerization reaction between itself and the two-liquid curing type epoxy resin sufficiently proceeds in relationship between a substrate resin and a curing agent, thus eliminating the possibility that unreacted components of the prepolymer of phenolsulfonic acid remain in the resin. As a result, the produced resin is free of residual acid components and thus ultra-hydrophilic.

The first reason why a prepolymer of phenolsulfonic acid is used for the curing agent is that it is a hydrophilic curing agent. The prepolymer of phenolsulfonic acid plays a role to initiate a reaction for curing an epoxy resin, and is effective in rendering the resin ultra-hydrophilic. The second reason is that a fabric constituent yarn, especially a polyamide yarn is easily hydrolyzed by a resin made by polymerizing phenolsulfonic acid being a strong acid. Monomers penetrate into the polyamide through the hydrolysis, and thereby the yarn itself becomes hydrophilic. That is, unlike a conventional structure in which a hydrophilic coating film constituted by an epoxy resin, a polyamine curing agent and polyvinyl pyrolidone is merely formed on a fabric constituent yarn, the prepolymer of phenolsulfonic acid has the function of rendering the yarn itself hydrophilic in addition to forming a hydrophilic coating film having a high level of film strength, thus making it possible to retain the antifouling effect even if the resin coating film is caused to fall off by abrasion and high pressure shower. Here, there may arise a concern about degradation of or the like of the fabric constituent yarn due to hydrolysis, but such a concern is eliminated as long as no residual acid components remain on the mixed resin, and once the resin completely cured, hydrolysis no longer proceeds, and therefore there is no possibility that properties as a papermaker's fabric are degraded. The resin can be dried and cured in short time by making, and stability of the fabric can be improved by heat, and thus the passage of the resin through the heater is preferable in a variety of aspects. The curing temperature after coating of the resin may be 100° C. or greater, e.g. about 100 to 130° C., but is preferably about 120° C. in terms of drying efficiency and other aspects related to production.

In addition, there is an advantage that cleaning required in a conventional antifouling fabric coated with a resin made by polymerizing a phenolic resin with a prepolymer of phenolsulfonic acid is not necessary in the present invention. A cure reaction proceeds when a curing agent is mixed with the two-liquid reaction type resin and in the present invention, even if the prepolymer of phenolsulfonic acid is poor in reactivity, the reaction easily proceeds because the relationship between a two-liquid reactive resin and a curing agent is retained, and therefore almost no unreacted components exist after the reaction. Thus, cleaning for removing residual acid components is not required. Furthermore, if the epoxy resin is blended with the prepolymer of phenolsulfonic acid in a suitable ratio, the amount of unreacted residual acid components can be considerably reduced. The suitable blending ratio more or less varies depending on the temperature and other conditions, but the epoxy resin is blended with the prepolymer of phenolsulfonic acid preferably in the ratio of approximately 10:2 to 10:6 by weight of resin. Further preferable is the ratio of 10:3. The level at which the reaction proceeds may change depending on the temperature and a variety of conditions, and if the amount of epoxy resin is excessive with respect to the curing agent, the resin curing reaction may be hard to proceed sufficiently, resulting in a situation in which a resin coating film having a satisfactory hardness is not formed, or the coating film on the constituent yarn is easily caused to fall off. Furthermore, if the amount of prepolymer of phenolsulfonic acid is excessive, a large amount of prepolymer of phenolsulfonic acid being a strong acid may remain in the resin after the reaction, and therefore a fabric having coated thereon a composition containing an excessive amount of precondensate of phenolsulfonic acid may require a cleaning step after forming a coating film.

The prepolymer of phenolsulfonic acid for use in the present invention is not specifically limited, but a material with a formalin based compound condensed with phenol sulfonic acid or the like is preferable. Furthermore, in addition to the precondensate of phenolsulfonic acid, a dye, an antifoaming agent, a leveling agent helping flatten the resin, a tackifier enhancing the strength of adhesion between the resin and the constituent yarn, a silane coupling agent improving adhesion properties, a solvent for diluting the resin and the like may be mixed.

Particularly, by mixing an acid dye and metallic complex salt dye with the antifouling resin of the present invention, the durability and hydrophilic nature of the resin coating film is still further be improved. The dye can stain the resin, allowing coating unevenness, durability and the like of the resin to be visually checked, but the durability of the resin coating film is also improved by mixing the acid dye and metallic complex salt dye with the antifouling resin of the present invention.

The acid dye and metallic complex salt dye are very well adsorbed to a polyester resin and a polyamide resin constituting wires, and they are more easily adsorbed to the polyamide resin. This is due to the fact that the dyeing active point of the dye is a carboxyl group or amino group that is a terminal group of polyamide, and adsorption also occurs in the amide group in the backbone chain in an acid solvent. The dye is negatively charged, and the carboxyl group, amino group and amide group of polyamide are positively charged, resulting in occurrence of ionic bonds. Dye molecules are strongly adsorbed to a synthetic resin being a fabric constituent yarn, thus making it possible to further strengthen the adhesion between a thermosetting resin and the fabric constituent yarn.

In the present invention, the antifouling resin coating film formed by coating the fabric constituent yarn with a resin made by mixing the acid dye and metallic complex salt dye with a resin made by blending the prepolymer of phenolsulfonic acid with the epoxy resin and curing the same can impart an ultra-hydrophilic nature in addition to excellent adhesion properties and durability of the epoxy resin, thus making it possible to prevent deposition a gum pitch for a long time period. In addition, the resin coating film is chemical-resistant, so that the resin coating film is not caused to fall off even if caustic soda, kerosene, limonene or the like is used for removing a persistent gum pitch stuck to the net.

A specific example of a method for forming the antifouling resin coating film on the surface of the fabric constituent yarn will now be described. For the papermaker's fabric, a synthetic resin filament woven using a warp and a weft and formed into an endless shape by a known seaming method is used. The antifouling resin is prepared by blending a two-liquid curing type urethane modified epoxy resin with the prepolymer of phenolsulfonic acid with in the ratio of 10:3 and sufficiently polymerizing the same, and the prepared resin is diluted to a concentration of 5% with MEK and methyl alcohol and then coated on the surface of the fabric. For the coating method, a roll or brush may be used, or a spray or the like may be used. The resin may be coated on either one side or both sides, but a sufficient antifouling effect can be exhibited by coating the resin on only one side of the fabric. Then, the fabric coated with the resin is made to pass a heater at about 120° C. to volatilize a solvent and the like and dry the fabric in short time, and the resin is cured.

Here a method of coating a woven fabric with a resin is used but instead thereof, a method may be used in which a yarn itself is coated with a resin to form an antifouling resin coating film on the surface of the yarn before a fabric is woven to be formed into an endless shape.

For the constituent yarn of the papermaker's fabric for use in the present invention, polyester and polyamide monofilaments having dimensional stability, abrasion resistance, rigidity and the like required for the papermaker's fabric are preferably used alone or in combination, but instead thereof, polyphenylene sulfide, polyvinylidene fluoride, polypropylene, aramid, polyether ether ketone, polyethylene naphthalate, polytetrafluoroethylene and the like may be used. Of course, yarns with a variety of substances blended or incorporated in copolymers and the above materials for predetermined purposes may be used. For the type of yarn, multifilaments, span yarns, finished yarns generally called textured yarns, bulky yarns and stretch yarns subjected to crimping, bulking and the like, or yarns combined by intertwining the above yarns and so on may be used in place of monofilaments. Furthermore, for the shape of the yarn, not only circular yarns but also yarns of rectangles such as tetragons and star shapes, elliptical and hallow yarns and the like may be used, and for the fabric structure, both single-layer fabrics and multilayer fabrics such as bilayer fabrics and trilayer fabrics may be applied, and there is no specific limitation on the fabric texture.

Particularly, since the antifouling resin of the present invention is adsorbed to a polyamide filament, the strength of adhesion between the antifouling resin and the polyamide filament is enhanced, thus making it possible to retain the antifouling effect for a long time period, and therefore a fabric with the polyamide filament placed on part of the surface of the fabric to be coated with the resin, and combined with a polyester monofilament can provide an excellent antifouling effect without impairment of various properties required as a papermaker's fabric.

EXAMPLES

Example of the present invention will be described comparing with Comparative Examples.

Example 1

A resin made by blending a two-liquid reaction type urethane modified epoxy base resin with a prepolymer of phenolsulfonic acid constituted by a condensate of phenolsulfonic acid and formalin in the ratio of 10:3 and sufficiently polymerizing the same was diluted to a concentration of 5% with MEK and methyl alcohol, the resin was coated on one side of a single layer fabric woven from a warp and weft constituted by a synthetic resin monofilament by a roll coating apparatus, and the fabric coated with the resin was heated at 120° C. to form an antifouling resin coating film on the surface of a fabric constituent yarn.

Comparative Example 1

A resin made by blending a phenol resin with a phenolsulfonic acid precondensate in the ratio of 1:1 was diluted to a concentration of 5% with MEK and methyl alcohol, and the resin was coated on one side of a single layer fabric woven from a warp and weft constituted by a synthetic resin monofilament by a roll coating apparatus, and was heated at 120° C. to form an antifouling resin coating film on the surface of a fabric constituent yarn.

Comparative Example 2

Single layer fabric woven from warp and weft constituted by synthetic resin monofilament

[Comparative Test]

Comparative test items included (1) antifouling effect retention performance, (2) chemical resistance and (3) acidity of resin.

(1) A fabric was subjected to a cleaning test as assumed use of the fabric, and thereafter a gum tape peel stress on the fabric was measured to make a comparison on susceptibility to deposition of a gum pitch. A comparison was made on the antifouling effect with a gum tape peel stress test because gum pitch components deposited on the fabric during papermaking of wastepaper and the like is equivalent to sticky components of the gum tape.

(2) Four types of reagents generally used in removal of the gum pitch were used to make a comparison on durability of resin by visual observations. A dye was added in the resin, so that there could be well recognized a change caused by chemical resistance of an antifouling resin when each fabric sample was dipped in the reagent.

(3) pH measurement. Each sample coated with resin was put in a test tube together with 20 cc of water, and the pH of the water was measured.

(1) Antifouling Effect Retention Performance

Samples of Example 1 and Comparative Examples 1 and 2 were dipped in water for 30 minutes, and were thereafter subjected to fan shower cleaning. This was carried out as a preliminary arrangement for adapting the samples to water to further improve their antifouling effects. Then, the samples were subjected to cleaning by a washer for 3 days, 10 days and 30 days, followed by carrying out the gum tape peel stress test to make a comparison on susceptibility of the fabric to deposition of the gum pitch. The test results are shown in Table 1. The unit of peel stress is g/25 mm because the width of the gum tape used in the gum tape peel stress test is 25 mm, and it can be considered that the smaller the value, the less susceptible to deposition of the gum pitch.

In this comparison test, a comparison is made on the antifouling effect based on the type and existence/nonexistence of antifouling resin, but abrasion resulting from frictions between the fabric and a papermaker's forming apparatus caused by the traveling of the fabric is involved in a full-scale practice, and therefore the values shown in Table are only reference values.

TABLE 1

| | Example 1 | Comparative Example 1 | Comparative Example 2 |
|---|---|---|---|
| before cleaning | 62 | 71 | 150 to 160 |
| after 3 days | 55 | 103 | 160 or greater |
| after 10 days | 72 | 138 | 160 or greater |
| after 30 days | 84 | 160 or greater | 160 or greater |

From the above results, Example 1 and Comparative Example 1 have almost same results before cleaning. It can be said that in both cases, the gum pitch is hard to be deposited in the early stage of use. In Example 1, the peel stress is further reduced after 3 days, and this is ascribable to gradual adaptation of the resin to water. No significant reduction in peel stress is found after 30 days in Example 1. From the results, it can be said that in Example 1, a sufficient antifouling effect could be retained from the early stage to the last stage. Furthermore, in Comparative Example 1, susceptibility to deposition of the gum pitch was increased as the test proceeded. Furthermore, in Comparative Example 2 in which co resin finishing was made, the peel stress was kept at a high level, and a high level of susceptibility to deposition of the gum pitch was maintained from the early stage to the last stage of use.

(2) Chemical Resistance

A dye was incorporated in each resin for use in Example 1 and Comparative Example 1, and a fabric coated with the resin to form an antifouling coating film thereon was dipped in four reagents shown below for 10 minutes, followed by making a judgment on the chemical resistance by visual observations from the loss of the dye.

1) caustic soda (10%)
2) hydrochloric acid
3) kerosene

TABLE 2

| | | Example 1 | Comparative Example 1 | Comparative Example 2 |
|---|---|---|---|---|
| 1) | caustic soda | ◎ | X | |
| 2) | hydrochloric acid | ◎ | Δ | |
| 3) | kerosene | ◎ | ○ | |

High level of chemical resistance ◎>○>Δ>X low level of chemical resistance

As shown in Table 2, the resin coating film was not caused to fall off in Example 1. That is, caustic soda, hydrochloric acid, kerosene or the like may be used for removing the gum pitch persistently stuck to the fabric, and it is effective to use MEK in the event that clogging occurs due to excessive coating of the resin. In this way, if reagents are selected and used as appropriate for cleaning the fabric and so on, the antifouling effect can be maintained for a long time period. On the other hand, in the result of Comparative Example, it can hardly be said that excellent chemical resistance was retained.

(3) Each sample with the resin coated thereon was put in a test tube together with 20 cc of water, and was treated in an ultrasonic cleaner for 30 minutes, and then the pH of the water was measured. In addition, the pH of the water after being left standing for 3 days was measured.

TABLE 3

| | Example 1 | Comparative Example 1 | Comparative Example 2 |
|---|---|---|---|
| after 30 days | 6.7 | 3.0 | |
| after 3 days | 7.0 | 2.8 | |

As shown in Table 3, the acidity of the resin in Example 1 is apparently different from that in Comparative Example 1. Example 1 shows a value of almost neutral, while in Comparative Example 1, it can be understood that since the phenol resin and the prepolymer of phenolsulfonic acid did not react completely, residual acid components existed after the reaction even if the resin coating film was apparently formed, and acid components were dissolved in water, resulting in acidification of the water. In the fabric represented by Comparative Example 1, a nylon yarn may be degraded due to existence of residual acid components, and therefore water cleaning is required.

As described above, the antifouling papermaker's fabric of the present invention is given antifouling properties by coating the surface of a constituent yarn with a resin composition constituted by a two-liquid reaction type epoxy resin and a prepolymer of phenolsulfonic acid as a curing agent to form an antifouling coating film, and this papermaker's fabric exhibits excellent effects such that an excellent antifouling effect can be retained for a long time period from the early stage of use to the last stage of use, the resin coating film is hardly caused to fall off even by high pressure shower owing to increased strength of the resin coating film and increased strength of adhesion between the resin coating film and the constituent yarn, the fabric is highly resistant to a reagent used for removal of a gum pitch, and so on.

The disclosure of Japanese Patent Application No. 2002-197088 filed on Jul. 5, 2002 including specification, drawings and claims is incorporated herein by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. An antifouling papermaker's fabric woven from a warp and weft made of synthetic resin filament, wherein the fabric is coated with a resin composition made by blending a two-liquid reaction type epoxy resin with a prepolymer of phenolsulfonic acid as a curing agent to form on the surface of a constituent yarn an antifouling coating film constituted by a reaction product of the composition.

2. The antifouling papermaker's fabric woven from a warp and weft made of synthetic resin filament according to claim 1, wherein the fabric is coated with a resin composition made by blending a two-liquid reaction type epoxy resin with a prepolymer of phenolsulfonic acid as a curing agent in the ratio of 10:2 to 10:6 to form on the surface of constituent yarn an antifouling coating film constituted by a reaction product of the composition.

3. The antifouling papermaker's fabric according to claim 1, wherein the fabric is woven using a constituent yarn having an antifouling coating film formed on the surface by coating the surface of a synthetic resin filament warp and weft with a resin composition made by blending a two-liquid reaction type epoxy resin with a prepolymer of phenolsulfonic acid, and subjecting the composition to a reaction.

4. The antifouling papermaker's fabric according to claim 2, wherein the fabric is woven using a constituent yarn having an antifouling coating film formed on the surface by coating the surface of a synthetic resin filament warp and weft with a resin composition made by blending a two-liquid reaction type epoxy resin with a prepolymer of phenolsulfonic acid, and subjecting the composition to a reaction.

5. An antifouling papermaker's fabric made by mixing an acid dye and/or a metallic complex salt dye with the resin made by blending a two-liquid reaction type epoxy resin with a prepolymer of phenolsulfonic acid according to claim 1.

6. An antifouling papermaker's fabric made by mixing an acid dye and/or a metallic complex salt dye with the resin made by blending a two-liquid reaction type epoxy resin with a prepolymer of phenolsulfonic acid according to claim 2.

7. An antifouling papermaker's fabric made by mixing an acid dye and/or a metallic complex salt dye with the resin made by blending a two-liquid reaction type epoxy resin with a prepolymer of phenolsulfonic acid according to claim 3.

8. An antifouling papermaker's fabric made by mixing an acid dye and/or a metallic complex salt dye with the resin made by blending a two-liquid reaction type epoxy resin with a prepolymer of phenolsulfonic acid according to claim 4.

9. The antifouling papermaker's fabric according to any one of claims 1 to 8, wherein the fabric woven from a warp and weft made of synthetic resin filament or the resin composition coated on the warp and weft is heated to a temperature of 100° C. or greater and thereby cured.

* * * * *